US008600286B2

(12) United States Patent
Chiyoda

(10) Patent No.: US 8,600,286 B2
(45) Date of Patent: Dec. 3, 2013

(54) CURLING MECHANISM AND IMAGE FORMING APPARATUS

(75) Inventor: Yasuharu Chiyoda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 13/155,809

(22) Filed: Jun. 8, 2011

(65) Prior Publication Data

US 2011/0318031 A1 Dec. 29, 2011

(30) Foreign Application Priority Data

Jun. 28, 2010 (JP) ..... 2010-146193

(51) Int. Cl.
*G03G 15/00* (2006.01)
*B65H 29/70* (2006.01)

(52) U.S. Cl.
USPC ..... 399/406; 399/400; 399/397

(58) Field of Classification Search
CPC ..... G03G 2215/00704; G03G 2215/00662; G03G 15/235; G03G 15/6576; B65H 2301/5121; B65H 2301/51256
USPC ..... 399/400, 406, 397; 271/276, 197, 194, 271/196, 188
See application file for complete search history.

(56) References Cited

U.S. PATENT DOCUMENTS

2009/0212497 A1 * 8/2009 Kawaguchi et al. ..... 271/308

FOREIGN PATENT DOCUMENTS

| | | | |
|---|---|---|---|
| JP | 8-146806 | | 6/1996 |
| JP | 09166928 A | * | 6/1997 |
| JP | 10-228199 | | 8/1998 |
| JP | 2007-033767 | | 2/2007 |

* cited by examiner

*Primary Examiner* — Daniel J Colilla
*Assistant Examiner* — John M Royston
(74) *Attorney, Agent, or Firm* — Fitzpatrick, Cella, Harper & Scinto

(57) ABSTRACT

The present invention provides an image forming apparatus having a conveying portion 8 includes a plurality of pre-fixing conveying belts 83 arranged in parallel to a width direction intersecting with the sheet conveying direction. The pre-fixing conveying belts convey a sheet to which a toner image is transferred by a fixing portion 9 to a fixing nip portion. The controlling portion controls a driving mechanism which moves at least one of the plurality of sheet conveying members and changes a projecting amount thereof with respect to the other sheet conveying member, and drives such that a conveying state of the pre-fixing conveying belt is obtained based on a state-setting table which is set according to type of sheet. It is possible to prevent sheet corrugated deformation as well as to solve a problem of generation of slip or distortion of a sheet caused by velocity difference between the driving portions.

7 Claims, 12 Drawing Sheets

① : CONCAVE CURL SHAPE ---
EFFECTIVE FOR IMAGE DEVIATION OF END OF LARGE-SIZE PAPER
② : ↑
③ : FLAT SHAPE ---
EXCELLENT CONVEYING FORCE OF THICK PAPER
④ : ↓
⑤ : CONVEX CURL SHAPE ---
EFFECTIVE FOR IMAGE DEVIATION OF CENTRAL PORTION OF SMALL-SIZE PAPER

SECOND SIDE CURL SHAPE

CORRUGATED SHAPE

CONCAVE CURL SHAPE OF CENTRAL PORTION IN SHEET-PASSING DIRECTION

CONVEX CURL SHAPE OF CENTRAL PORTION IN SHEET-PASSING DIRECTION

CURLING MECHANISM AND IMAGE FORMING APPARATUS

BACKGROUND OF THE INVENTION

1. Field of the Invention

The present invention relates to an imageforming apparatus for obtaining a hard copy, such as a copying machine, a facsimile machine and a printer, including an image forming portion which forms a toner image on a sheet utilizing an electrophotographic process by a transfer system or a direct system and a fixing portion which fixes the toner image on the sheet.

2. Description of the Related Art

In an image forming apparatus of an electrophotographic system, when a non-fixed toner image is transferred to a sheet by a transfer portion and this sheet is conveyed to a fixing portion, the sheet is generally conveyed by a conveying belt which is in contact with a non-image surface and the sheet enters a fixing nip portion. At that time, however, especially in the case of a thin media (type of sheet), the sheet is conveyed with a wrinkle or slack in some cases. At the same time, a conveying ability accepting conveyance of a thick sheet is also required, and when a conveying force of a sheet is weak, slip or skew feeding of a sheet may occur.

Further, even if a wrinkle or slack is small, when a sheet tip end is caught in a fixing nip portion, the wrinkle is amplified and becomes a large wrinkle in some cases. It is important to stabilize the pre-fixing sheet conveyance for enhancing quality of a fixing operation to satisfy wide media. The above problem is indicated in the pre-fixing conveying portion, and various techniques for stably conveying sheets are discussed.

As a configuration for preventing slack of a sheet, there is one in which conveying portions including at least two sets of belts are driven at different velocities to prevent the slack of the sheet and as a result, stable conveyance at the pre-fixing conveying portions before the sheet enters the fixing portion is realized (see Japanese Patent Laid-Open No. 2007-033767).

According to this conventional technique, a controlling portion controls a plurality of driving portions such that conveying velocities of both ends in a direction intersecting with a conveying direction of a sheet become faster than a conveying velocity of a central portion of the sheet in a width direction of the sheet. That is, when three driving portions are located in the width direction of the sheet, for example, control is performed such that conveying velocities of the sheets on both ends by the driving portion become faster than the conveying velocity of the sheet by the central driving portion. By making the conveying velocities of both ends of the sheet faster than the conveying velocity of the central portion, it is possible to guide the sheet to a nip portion which is formed by contact between the fixing portion and the driving portions while biasing the sheet such as to widen the sheet in the direction intersecting with the conveying direction.

If the sheet is guided to the fixing nip portion while widening the sheet in the width direction with velocity difference between the driving portions, it is possible to decrease a wrinkle or image failure which may be caused by a passing posture of the sheet, but there is a possibility that the following problem is caused. That is, by making the conveying velocities different from each other in the width direction of the sheet, an effect of smoothing a wrinkle of a sheet can be expected, but due to the velocity difference between the driving portions, there is an adverse possibility that slip or distortion of the sheet is generated between the driving portions having the velocity difference. When the driving portion includes an endless belt for example, it is necessary to complicate or optimize a "vacuum plenum (slip limitation/before fixing/vacuum transfer apparatus)" and a "perforated belt". It is difficult to accept a plurality of media (surface properties/basis weight/size) and it is necessary to variously change setting conditions.

Hence, the present invention provides an image forming apparatus capable of preventing a sheet deformation such as curl and corrugation while solving the problem of generation of slip or distortion of a sheet caused by velocity difference between the driving portions.

SUMMARY OF THE INVENTION

The present invention provides an image forming apparatus comprising a transfer portion which transfers a toner image to a conveyed sheet; a fixing portion which makes the sheet to which the toner image is transferred by the transfer portion enter to fix the toner image; a conveying portion disposed between the transfer portion and the fixing portion, the conveying portion includes a plurality of sheet conveying members arranged in parallel to a width direction intersecting with a sheet conveying direction, the sheet conveying members convey the sheet on sheet conveying surfaces of the sheet conveying members, to which the toner image is transferred by the transfer portion, to the fixing portion; the driving mechanism drives such that at least one of the plurality of sheet conveying members is projected in a direction perpendicular to the sheet conveying surface and a projecting amount of the at least one sheet conveying member with respect to the other sheet conveying member is changed and the controlling portion controls the driving mechanism such that the projecting amount of the sheet conveying member based on a data of a state-setting table which is set according to type of sheet.

According to the present invention, by controlling the driving mechanism, it is possible to obtain the conveyance state of the sheet conveying member based on the status-setting table according to type of sheet. According to this, it is possible to realize an image forming apparatus capable of preventing a sheet deformation such as curl and corrugation while solving the problem of generation of slip or distortion of a sheet P caused by velocity difference between the driving portions.

Further features of the present invention will become apparent from the following description of exemplary embodiments with reference to the attached drawings.

DESCRIPTION OF THE EMBODIMENTS

The present invention will be described based on embodiments. These embodiments are one example of an exemplary embodiment of the embodiment, but the embodiment is not limited to the embodiments.

Figure 1:
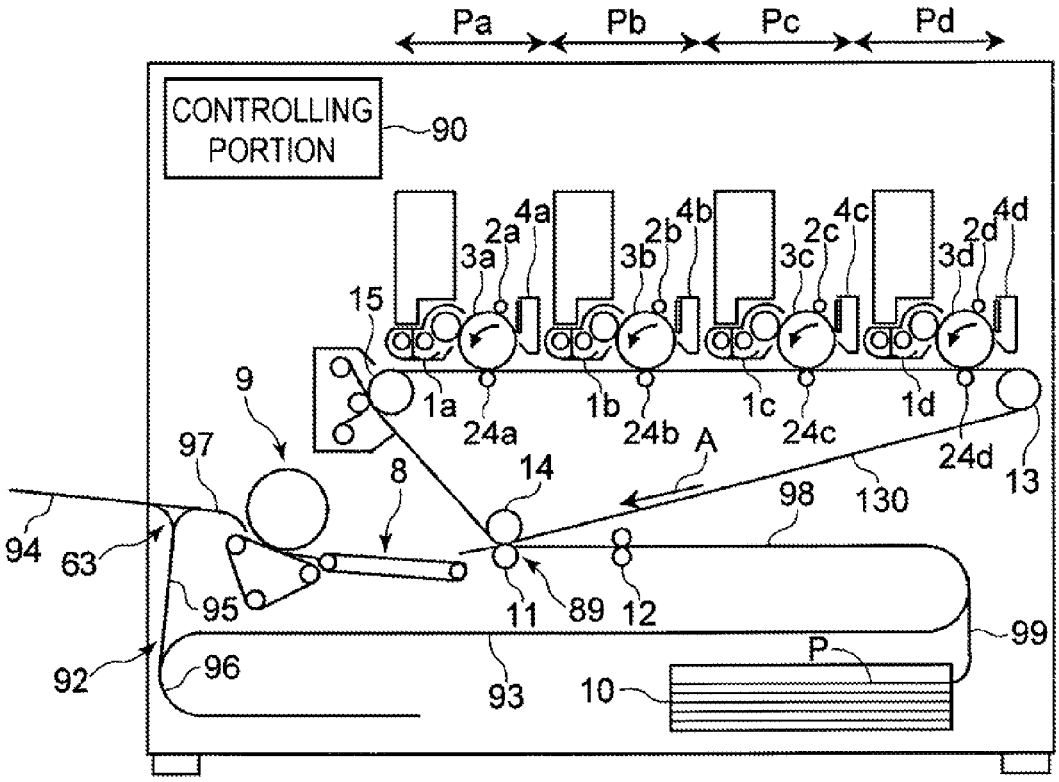
FIG. 1 is a schematic sectional view of an image forming apparatus according to the present invention.

<First Embodiment> As illustrated in FIG. 1, an image forming apparatus has an apparatus body, and first, second, third and fourth image forming portions Pa, Pb, Pc and Pd are provided in the apparatus body. Toner images of different colors are formed through a latent image process, a development process and a transfer process. Disposed in the apparatus body are a secondary transfer portion (transfer portion) 89 which transfers a toner image to a conveyed sheet P, a pre-fixing conveying portion (a conveying portion) 8, a fixing portion 9, and a controlling portion 90 which controls these members. The fixing portion 9 makes the sheet P to which the toner image is transferred by the secondary transfer portion 89 enter, and fixes the toner image.

The first to fourth image forming portions Pa to Pd include special image bearing members, in this embodiment, electrophotographic photosensitive drums 3*a*, 3*b*, 3*c* and 3*d*, respectively, and toner images of respective colors are formed on the photosensitive drums 3*a* to 3*d*. An intermediate transfer member 130 is disposed in adjacent to the photosensitive drums 3*a* to 3*d*, the toner images of the respective colors formed on the photosensitive drums 3*a* to 3*d* are primary transferred to the intermediate transfer member 130, and the toner images are transferred to a sheet P by a secondary transfer portion. The intermediate transfer member 130 is an endless belt, and is wound around rollers 13, 14 and 15 and supported. The toner image transferred to the sheet P is fixed by the fixing portion 9 through a heating process and a pressurizing process and then the sheet P is discharged out from the apparatus as a fixed image.

Provided on outer peripheries of the photosensitive drums 3*a* to 3*d* are drum chargers 2*a*, 2*b*, 2*c* and 2*d*, development devices 1*a*, 1*b*, 1*c* and 1*d*, primary transfer chargers 24*a*, 24*b*, 24*c* and 24*d* and cleaners 4*a*, 4*b*, 4*c* and 4*d*, respectively. A light source apparatus and a polygon mirror (both not illustrated) are provided in an upper portion in the apparatus body.

In the image forming apparatus, laser light emitted from a light source apparatus is scanned by rotating the polygon mirror, light flux of the scanned light is deflected by a reflection mirror, the light is condensed on buses of the photosensitive drums 3*a* to 3*d* by fθ lenses and it is exposed to light. According to this, latent images corresponding to image signals are formed on the photosensitive drums 3*a* to 3*d*.

Predetermined amounts of cyan, magenta, yellow and black toner are charged into the development devices 1*a*, 1*b*, 1*c* and 1*d* by a supply apparatus (not illustrated) as developers. The development devices 1*a* to 1*d* develop latent images on the photosensitive drums 3*a* to 3*d*, and the images are visualized as a cyan toner image, a magenta toner image, a yellow toner image and a black toner image. The intermediate transfer member 130 is rotated and driven at the same circumferential velocity as that of the photosensitive drum 3 in the direction of the arrow A.

In the process of passing through a nip portion between the photosensitive drum 3*a* and the intermediate transfer member 130, a yellow toner image as a first color which is formed and borne on the photosensitive drum 3*a* is intermediately transferred on an outer peripheral surface of the intermediate transfer member 130 by a pressure and an electric field formed by a primary transfer bias applied to the intermediate transfer member 130.

A secondary transfer roller 11 in the secondary transfer portion 89 is disposed such that a shaft of the secondary transfer roller 11 is received in parallel to the intermediate transfer member 130 and the secondary transfer roller 11 is in contact with a lower surface thereof. Desired secondary transfer bias is applied to the secondary transfer roller 11 by a secondary transfer bias source. In the transfer process in which a composite color toner image which is superimposed on and transferred to the intermediate transfer member 130 is transferred to a sheet P, the sheet P passes through the registration roller 12 and a pre-transfer guide from a sheet cassette 10 through conveying paths 99 and 98. This sheet P is supplied to an abutment nip between the intermediate transfer member 130 and the secondary transfer roller 11 at the predetermined time and at the same time, the secondary transfer bias is applied from a bias power supply. The composite color toner image is transferred from the intermediate transfer member 130 to the sheet P by the secondary transfer bias.

Similarly, a second color magenta toner image, a third color cyan toner image and a fourth color black toner image are sequentially superimposed on and transferred to the intermediate transfer member 130, and a composite color toner image corresponding to a target color image is formed. Residual transfer toner is cleaned and removed from the photosensitive drums 3*a* to 3*d* whose primary transfer operations were completed by the cleaners 4*a*, 4*b*, 4*c* and 4*d*, and the photosensitive drums 3*a* to 3*d* are brought into standby states for a subsequent latent image forming operation. A cleaning web (nonwoven fabric) 19 is abutted against a surface of the intermediate transfer member 130, and wipes away toner remaining on the intermediate transfer member 130 and other foreign matters. The sheets P to which the toner images are transferred are sequentially guided into the below-described fixing portion 9, and heated and pressurized and the image is fixed. The below-described pre-fixing conveying portion 8 is disposed between the fixing portion 9 and the secondary transfer roller 11.

The image forming apparatus includes a turn-over portion 92 which turns over a sheet P on which an image is formed by the secondary transfer portion 89 and the fixing portion 9, and a duplex image-forming re-conveying path 93 for again sending the sheet P which is turned over by the turn-over portion 92 to the image forming step. The image forming apparatus has a single-sided printing (single-sided image forming) function for printing an image on one side of a sheet P, and a duplex printing (duplex image forming) function for printing images on two sides of a sheet P.

A branch conveying path 63 which sends out a sheet P to a discharge tray 94 is provided downstream of the fixing portion 9 in a conveying path 97. Turn-over conveying paths 95 and 96 branch off downward from the branch conveying path 63, and the re-conveying path 93 branches off from between the turn-over conveying paths 95 and 96 of the turn-over portion 92.

A switch member (not illustrated) switches conveyance of a sheet from the conveying path 97 to the discharge tray 94 or the turn-over conveying path 95, and switches conveyance of a sheet which is sent from the turn-over conveying path 95 to the turn-over conveying path 96 and turned over to the re-conveying path 93. The switch member is controlled by the controlling portion 90. The controlling portion 90 controls conveying sequence of sheets of the entire image forming apparatus. A large number of conveying roller apparatuses (not illustrated) are disposed in the conveying paths 97, 98 and 99, the turn-over conveying paths 95 and 96 and the re-conveying path 93. In each of the conveying roller apparatuses, a sheet P is conveyed in a state where it is nipped between a driving roller and a follower roller.

When the duplex image forming (duplex printing) is required, a sheet P on which a toner image is fixed by the fixing portion 9 is sent to the turn-over conveying path 95 by the switching operation of the switch member, and the sheet P is sent to the turn-over conveying path 96 of the turn-over portion 92. The sheet P is turned over on the turn-over conveying path 96, a tip end and a rear end thereof are turned over, and the sheet P is again conveyed to the re-conveying path 93 by the switching operation of the switch member. Thereafter, the sheet P merges with the conveying path 98 from an again-supplying path of the re-conveying path 93 at the right time with a sheet P of a subsequent job conveyed from the sheet cassette 10 through the conveying path 99, and the sheet P is sent to the registration roller 12 and the secondary transfer portion 89. An image is formed on the sheet P in the same manner as that described above.

Figure 2:
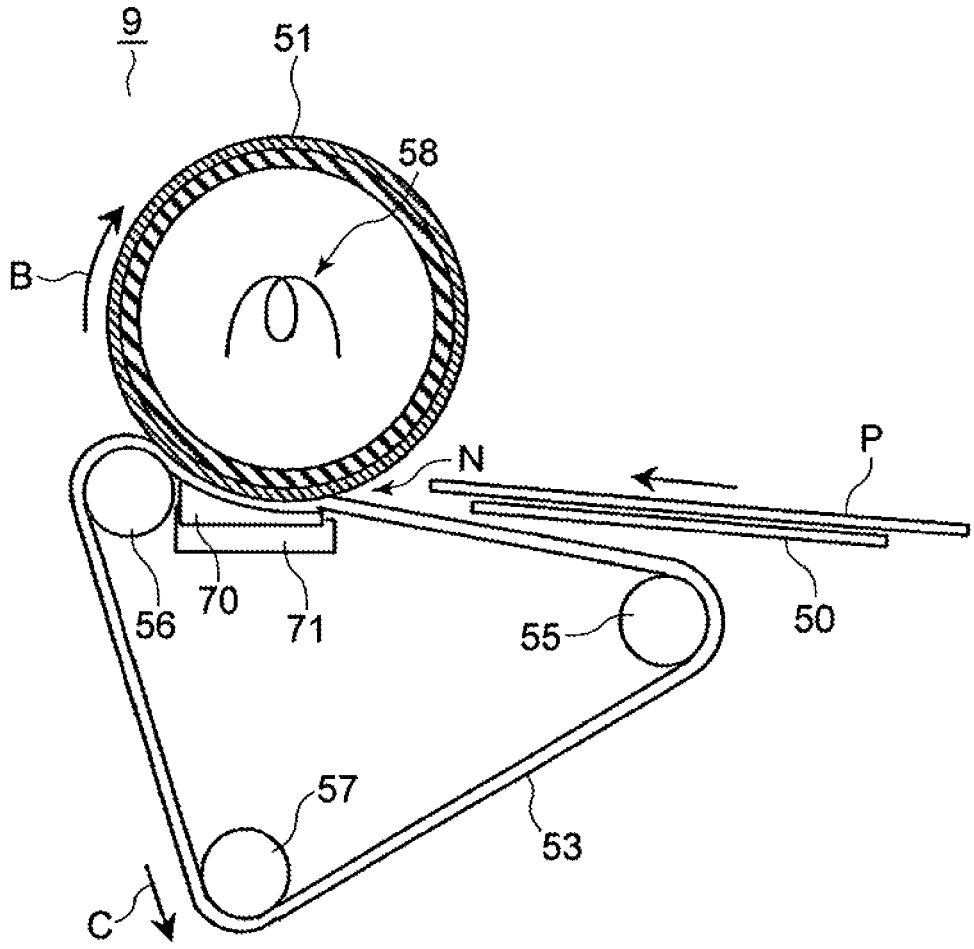
FIG. 2 is a schematic sectional view of a fixing portion provided in the image forming apparatus according to the invention.

Next, a configuration of the fixing portion 9 will be described in detail with reference to FIG. 2. In this embodiment, as illustrated in FIG. 2, using an endless pressure belt (fixing belt) 53 which is wound around a plurality of rollers 55 to 57, the pressure belt 53 is brought into abutment against the fixing roller 51. That is, a fixing portion of a belt-fixing configuration is used in such a manner that the pressure belt 53 is pressurized against the fixing roller 51 by a pressure member having a pressurizing pad 70 and a pressurizing pad support portion 71 through a sliding member (not illustrated) from inside of the pressure belt 53, and a fixing nip portion N is formed. The fixing roller 51 and the pressure belt 53 constitute a pair of rotating members of the fixing portion. Reference numeral 50 represents a pre-fixing sheet-passing guide.

The fixing roller 51 is rotated and driven in a clockwise direction (direction of the arrow B) in FIG. 2. The pressure belt 53 rotates in the direction of the arrow C to follow the rotation of the fixing roller 51. The fixing roller 51 is formed by coating a core metal made of aluminum of 3 mm thickness with an elastic body layer of silicon rubber or fluorine rubber, and an elastic layer may be coated with fluorine resin such as a PFA tube of 10 to 100 μm thickness as a surface layer. The pressure belt 53 is formed by coating a surface of a base material which is resin such as polyimide or metal such as nickel with an elastic body layer made of silicone rubber or fluorine rubber, and an elastic layer may be coated with fluorine resin such as a PFA tube of 10 to 100 μm thickness as a surface layer.

A halogen heater 58 which is a heat source is disposed in the fixing roller 51. A thermistor is disposed on the fixing roller 51 in a contact manner, voltage to the heater is controlled through a temperature adjusting circuit (not illustrated), and a temperature is adjusted such that a surface temperature of the fixing roller 51 becomes 180° C. The roller 56 of the rollers 55 to 57 around which the pressure belt 53 is wound is a separation roller made of metal, the roller 56 pressurizes such as to bite into the fixing roller 51 through the pressure belt 53, thereby deforming the elastic body of the fixing roller 51, and the roller 56 separates a sheet P from a surface of the fixing roller 51. The pressurizing pad 70 has such a configuration that an elastic body such as silicone rubber or fluorine rubber is disposed on a metal base, and the pressurizing pad 70 pressurizes the fixing roller 51 through the pressure belt 53. Generally, a sliding member for enhancing sliding performance is provided between the pressurizing pad 70 and the pressure belt 53, and lubricant is used on an inner surface of the pressure belt 53.

If the fixing roller 51, the endless pressure belt 53 and the pressurizing pad 70 form the fixing nip portion N as described above, it is possible to form the wide fixing nip portion N such that it is wound around the outer periphery of the fixing roller 51 by the pressure belt 53. This is advantageous for increasing velocity and for fixing of a thick sheet.

If the separation roller (56) is pressurized such that it bites into a surface of the fixing roller 51, excellent separating performance of sheets is exerted and this is advantageous for increasing the velocity. A cooling fan (not illustrated) is disposed at a position where the pressure belt 53 is cooled, and the cooling fan is controlled by the controlling portion 90. This embodiment has such a configuration that the pressurizing pad 70 slides on the pressure belt 53 to pressurize the pressure belt 53, a width of the pressurized and formed fixing nip portion N is 20 mm or more and it tends to be longer than the fixing portion which uses a roller for the pressure member. Hence, behavior of a sheet P in the nip portion is largely associated with fixing of a toner image formed on the sheet.

Japanese Patent Laid-Open Nos. 8-146806 and 10-228199 discuss that behavior of a sheet which passes between a fixing roller and a pressure member is largely varied by a shape and a line pressure of a fixing nip portion formed by the fixing roller and the pressure member. When the pressure member is formed from the endless belt as in the embodiment, a central portion of the belt in its longitudinal direction has the highest pressure, and the pressure is decreased toward ends of the belt to prevent a wrinkle of a sheet in the nip. At that time, the following abnormal examples may occur depending upon a state of a sheet or type of media. The example A: a pressure at an end of a pressure nip is high, and a sheet is conveyed from its end with tension. In this case, a force in a widening direction is applied to the end of the sheet, and image deviation or sheet wrinkle is generated at a rear half of the central portion of the sheet. The example B: a pressure at the central portion of a pressure nip is high, and a sheet is conveyed from its central portion with tension. In this case, a force in a direction approaching the central portion is applied to the sheet, and image deviation is generated at the end of the sheet.

According to the configuration of this embodiment, the example A is a phenomenon which frequently appears when a sheet is of A3 size or less. This is because that a pressure at the end of the sheet is largely decreased as compared with the central portion thereof, a temperature of the fixing roller and a temperature at an end of the pressure belt are increased, and the velocity of the end is increased and thus this example occurs. The example B frequently appears when a sheet is wider than A3 size. It would appear that since a pressure at the end of the fixing nip portion is low, a velocity difference between the end and the central portion is increased.

[Pre-fixing conveying portion] The pre-fixing conveying portion 8 (see FIG. 1) disposed in the apparatus body is provided as a conveying route of a sheet P which connects the secondary transfer portion 89 and the fixing portion 9 when the sheet P to which a toner image is transferred is introduced to the fixing portion 9. FIG. 4B is an image diagram (plan view) illustrating a driving unit of the pre-fixing conveying portion 8 used for the image forming apparatus of the invention as viewed from an upper surface thereof.

In this embodiment, the pre-fixing conveying portion 8 is divided into three pieces, i.e., a central portion and both ends in a width direction intersecting with a sheet conveying direction, and each of the pieces is provided with a belt conveying driving device. The pre-fixing conveying portion 8 is disposed between the secondary transfer portion 89 and the fixing portion 9. The pre-fixing conveying portion 8 includes a plurality of (three in this embodiment) sheet conveying members arranged in parallel to each other. A sheet P to which a toner image is transferred by the fixing portion 9 is placed on a sheet conveying surface, and the sheet conveying members convey the sheet to the fixing nip portion N of the fixing roller 51 of the fixing portion 9 and the pressure belt 53. That is, the pre-fixing conveying portion 8 includes pre-fixing conveying belts 83*a*, 83*b* and 83*c* as the sheet conveying members which are arranged in parallel to the width direction (vertical direction in FIG. 4B) intersecting with the sheet conveying direction (lateral direction in FIG. 4B).

Each of the pre-fixing conveying belts (conveying belts) 83*a*, 83*b* and 83*c* as the sheet conveying members which suck and convey a sheet P to which a toner image is transferred has a length of 250 mm in a traveling direction, a lateral width of 100 mm, and a distance of 15 mm is provided between the pre-fixing conveying belts. Each of the conveying belts 83*a*, 83*b* and 83*c* is disposed bilaterally symmetrically with respect to a center in the width direction intersecting with the sheet conveying direction. The pre-fixing conveying belts 83*a*, 83*b* and 83*c* are also collectively called a pre-fixing conveying belt 83.

The secondary transfer portion 89 drives for conveyance for about 10 mm after the transfer portion, and a sheet P is delivered to the pre-fixing conveying portion 8 at intervals of 5 mm. A sheet-passing guide made of SUS with no drive is disposed immediately before the secondary transfer portion 89. The sheet-passing guide has a rib having a width of about 40 mm to enhance the sliding performance. A sheet is conveyed on the sheet-passing guide by driving the pre-fixing conveying portion and the fixing roller. The belt conveying driving devices use one common motor, and velocities of the three conveying portions become the same. To change a position of the belt conveying driving portion in the vertical direction with respect to the traveling direction (conveying direction), a cam for adjusting the position is provided, and the belt conveying driving devices are driven by a cam-operating motor. This set position can be changed in a stepless manner in a range of ±15 mm in the vertical direction.

Figure 4A:
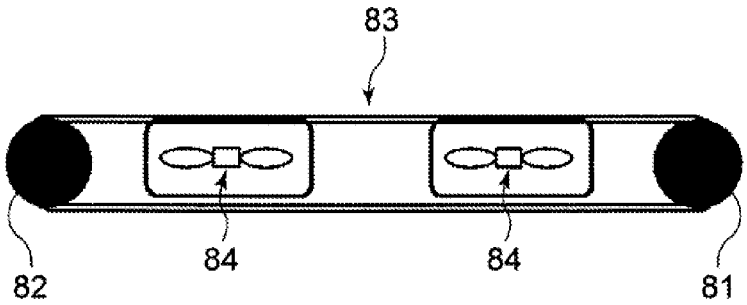
FIG. 4A is a schematic side view of a pre-fixing conveying portion of the first embodiment as viewed from a side surface thereof.
Figure 4B:
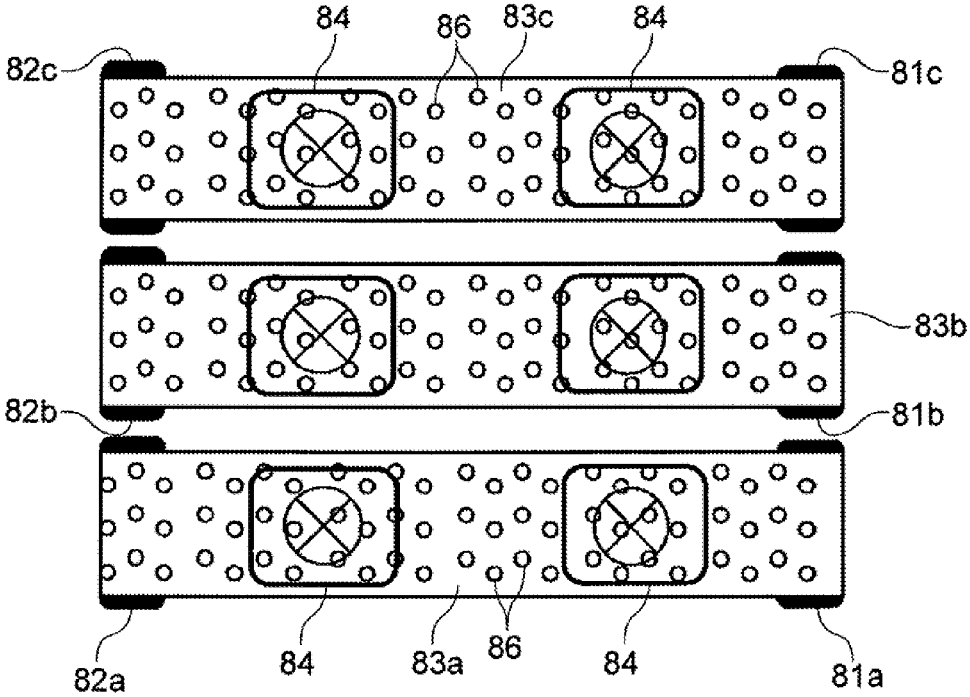
FIG. 4B is a schematic plan view of the pre-fixing conveying portion as viewed from an upper surface thereof.

FIG. 4A is an image diagram (side view) of the pre-fixing conveying portion as viewed from a side surface thereof. A large number of holes 86 through which air can pass are formed in the pre-fixing conveying belts 83*a* to 83*c* of the pre-fixing conveying driving unit at equal distance from one another. The pre-fixing conveying belts 83*a* to 83*c* are rotatably supported in a state where they are wound around conveying belt support rollers 81 and 82. The pre-fixing conveying driving unit is sucked and conveyed by negative pressure generated by suction fans 84 disposed in the pre-fixing conveying belts 83*a* to 83*c* such that a sheet on the pre-fixing conveying belts 83*a* to 83*c* does not slip when it is conveyed. In FIG. 4B, the conveying belt support rollers 81 and 82 corresponding to the pre-fixing conveying belts 83*a* to 83*c* are illustrated as conveying belt support rollers 81*a*, 81*b*, 81*c* and 82*a*, 82*b*, 82*c*.

Figure 7A:
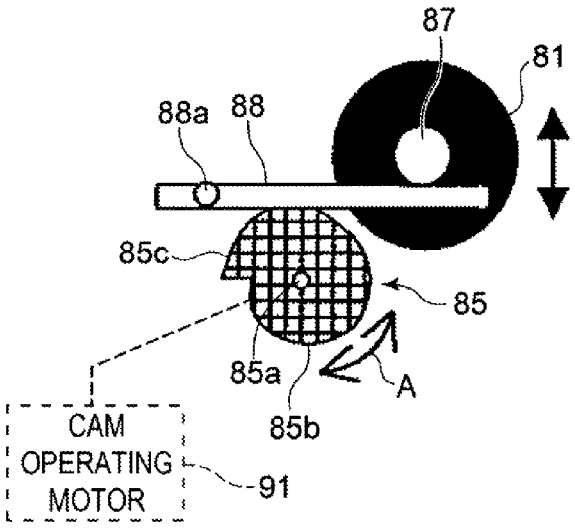
FIG. 7A is a diagram for describing a configuration of a projection operation of the pre-fixing conveying portion in the first embodiment.
Figure 7B:
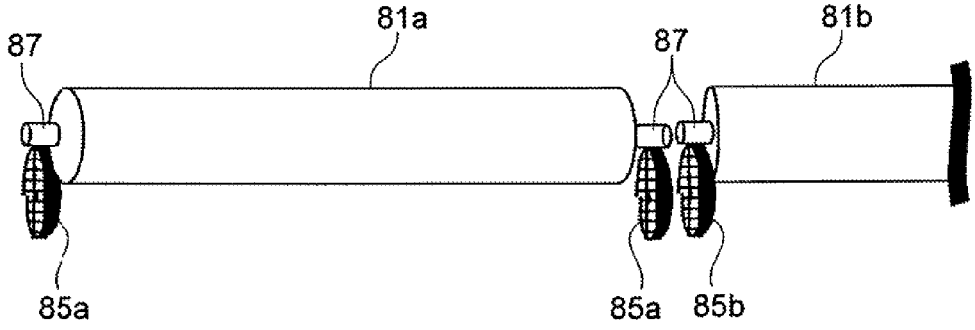
FIG. 7B is a diagram for describing the configuration of the projection operation of the pre-fixing conveying portion in the first embodiment.

As illustrated in FIGS. 7A and 7B, projecting-amount changing cams 85 for adjusting height positions to change a position of the belt conveying driving portion in the vertical direction with respect to the traveling direction of sheets are provided at illustrated positions of shafts 87 of the conveying belt support rollers 81*a*, 81*b* and 81*c*. Each of the projecting-amount changing cams 85 includes a small-diameter portion 85*b* and a large-diameter portion 85*c*, and a center shaft 85*a* is rotatably supported by a support portion (not illustrated), and the shaft 85*a* is rotatably driven by the cam operating motor 91 in the direction of the arrow A. The setting position for adjusting the height position can be varied by the projecting-amount changing cam 85 in a stepless manner in a range of ±15 mm.

A transmission member 88 is disposed between a shaft 87 of the conveying belt support roller 81 and the projecting-amount changing cam 85. The transmission member 88 can turn around a rotatably supported shaft 88*a*. Variation in position of the projecting-amount changing cam 85 in the vertical direction by the small-diameter portion 85*b* and the large-diameter portion 85*c* when the projecting-amount changing cam 85 rotates is transmitted to the shaft 87 through a transmission member 88 and according to this, the height position of the conveying belt support roller 81 is adjusted.

In the FIGS. 7A and 7B, only the conveying belt support roller 81 is illustrated for convenience sake, but the conveying belt support roller 82 also has the same configuration. In FIG. 7B, the projecting-amount changing cam 85 corresponding to the conveying belt support roller 81*a* is designated with reference numeral 85*a*, and the projecting-amount changing cam 85 corresponding to the conveying belt support roller 81*b* is designated with reference numeral 85*b*.

Delivery portions of a sheet from the secondary transfer portion 89 to the fixing portion 9 have sufficient height differences from each other so that even if the pre-fixing conveying portion 8 is vertically driven in a range of ±15 mm, a sheet can be delivered without conveyance delay. The type of sheets having narrow width is not included.

Figure 3:
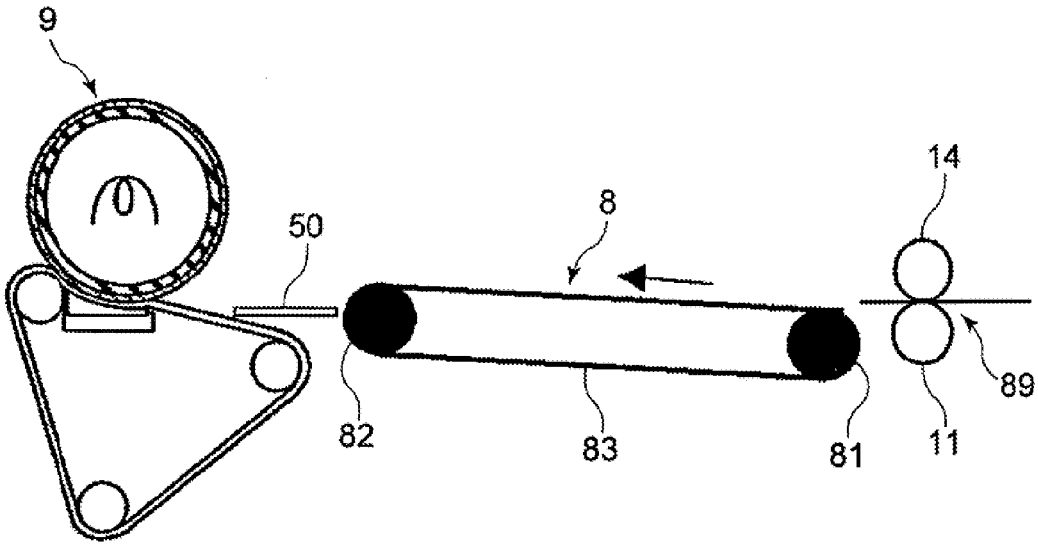
FIG. 3 is a layout diagram of the fixing portion of a first embodiment according to the invention.

By a driving mechanism which operates the pre-fixing conveying portion 8 in the vertical direction, operation modes of the image forming apparatus including a plurality of pre-fixing conveying portion drive modes can be switched according to conditions of sheets P passing through the pre-fixing conveying portion 8. When the traveling direction of the pre-fixing conveying portion drive is set from right to left as illustrated in FIG. 3, the pre-fixing conveying belt on the front side of the pre-fixing conveying belt 83 is designated with reference numeral 83*a*, the central conveying belt is designated with reference numeral 83*b*, and the conveying belt on the deep side is designated with reference numeral 83*c*. In FIG. 3, reference numeral 50 represents a pre-fixing sheet-passing guide.

The controlling portion 90 drives and controls the driving mechanism such that a projecting degree of the pre-fixing conveying belt 83*b* disposed near the central portion in the width direction (vertical direction in FIG. 4B) is increased or decreased relative to the adjacent pre-fixing conveying belts 83*a* and 83*c*. This driving mechanism drives such that at least one of the pre-fixing conveying belts 83*a* to 83*c* is moved in a direction perpendicular to the sheet conveying surface (vertical direction in FIG. 4A), and the projecting amount with respect to other pre-fixing conveying belts is changed. The driving mechanism includes the cam operating motor 91, the projecting-amount changing cam 85 and the transmission member 88.

The controlling portion 90 includes a table (not illustrated), and data (see Table 1) for driving and controlling the driving mechanism is stored in the table so that conveying states of the pre-fixing conveying belts 83*a* to 83*c* which are set according to type of sheets can be obtained. The controlling portion 90 reads corresponding data from the table so that the projecting degrees of the pre-fixing conveying belts 83*a* to 83*c* are changed according to type of sheet (e.g., type of paper, lateral width and basis weight) which passes through the pre-fixing conveying portion 8, and drives and controls the driving mechanism. More specifically, the controlling portion 90 controls a rotation angle of the cam operating motor 91 in the driving mechanism.

Figure 5A:
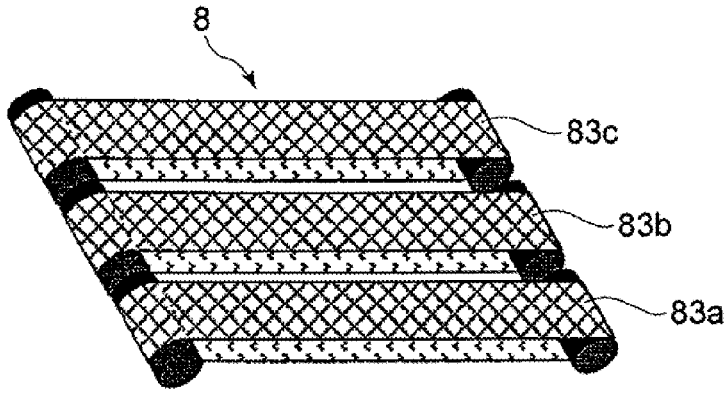
FIG. 5A is a schematic perspective view of the pre-fixing conveying portion at the time of normal operation I in the first embodiment.
Figure 5B:
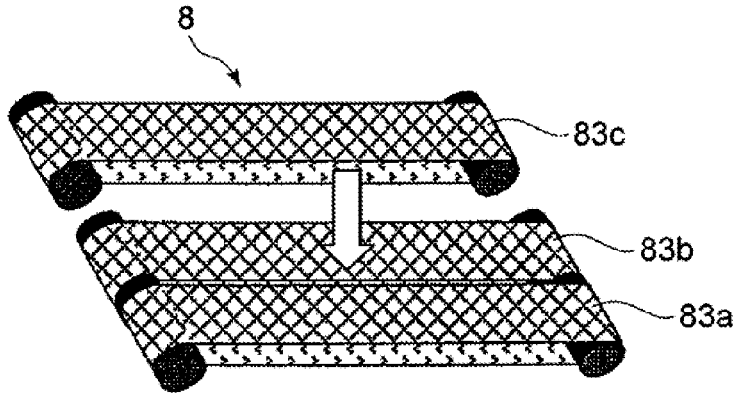
FIG. 5B is a schematic perspective view of the pre-fixing conveying portion at the time of concave curl operation II.
Figure 5C:
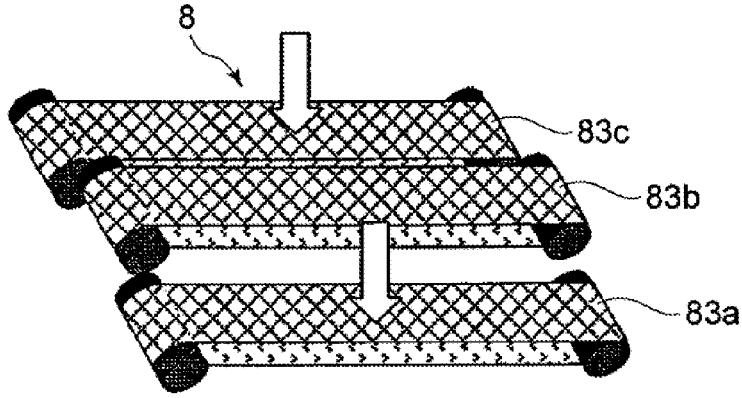
FIG. 5C is a schematic perspective view of the pre-fixing conveying portion at the time of convex curl operation III.

The drive modes of the pre-fixing conveying portion 8 in this embodiment are as follows: I. At the time of normal operation (FIG. 5A), the pre-fixing conveying belts 83*a* to 83*c* are operated at height (±0 position); II. At the time of concave curl operation (FIG. 5B), the central pre-fixing conveying belt 83*b* is lowered by one step (−10 mm position) and operated. The pre-fixing conveying belts 83*a* and 83*c* on both ends are operated at height (±0 position); III. At the time of convex curl operation (FIG. 5D), the central pre-fixing conveying belt 83*b* is operated at height (±10 mm position). The pre-fixing conveying belts 83*a* and 83*c* on both ends are lowered by one step (−10 mm position) and operated.

FIGS. 6A to 6D are image diagrams concerning a sheet passing shape of the pre-fixing conveying portion 8 when the above I to III are set. Sheets P shown with thick lines show shapes of cross sections taken along the traveling direction, and black square boxes shows the pre-fixing conveying belts 83*a* to 83*c* as the conveying portions.

Figure 6A:
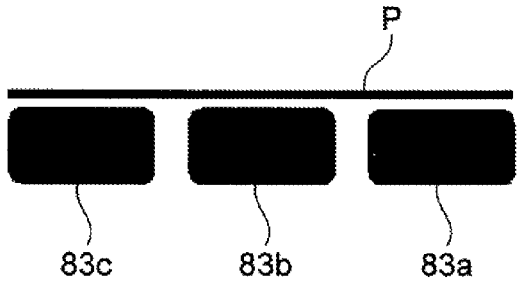
FIGS. 6A to 6D are image diagrams illustrating shapes of sheets which pass through the pre-fixing conveying portion in the first embodiment.
Figure 6B:
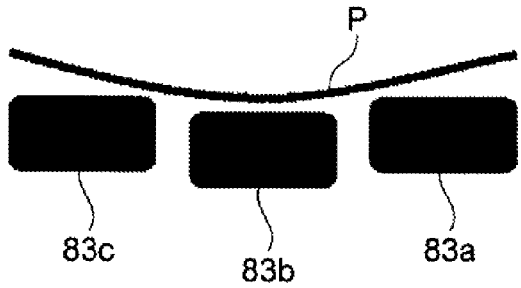

At the time of the normal operation I, as illustrated in FIG. 6A, the sheet P has a flat shape and is conveyed. At the time of operation II, a sheet P is supported mainly by the pre-fixing conveying belts 83*a* and 83*c* on the both ends and conveyed. In FIG. 6B, a load of a sheet P applied to the central pre-fixing conveying belt 83*b* is small but the sheet P is attracted by the suction fan 84 in the lower portion of the belt, and the sheet P is curled in a concave form.

Figure 6C:
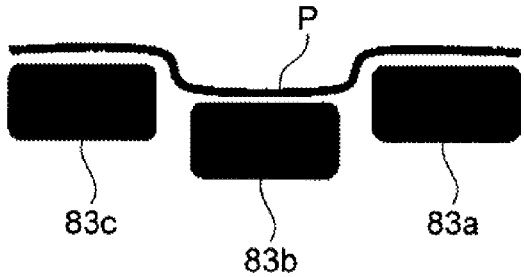
Figure 6D:
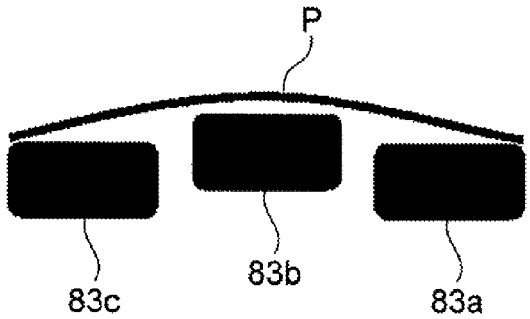

Concerning a thin sheet having low basis weight and low rigidity, a sheet P actually strictly follows the pre-fixing conveying belts 83*a* to 83*c* like a shape of a sheet P illustrated in FIG. 6C. However, the shape when the sheet enters the fixing nip portion N of the fixing portion 9 is moderated by the pre-fixing sheet-passing guide 50, and the sheet is formed into nearly a shape of a sheet P illustrated in FIG. 6B. Since it is an object of this embodiment to change a shape mainly with respect to a thin sheet, the configuration of the embodiment in which the thinner a sheet becomes, the greater the variation becomes is optimal.

At the time of convex curl operation III, a load of a sheet P is applied to the central pre-fixing conveying belt 83*b*, and the sheet is conveyed in a state where an end of the sheet is attracted by the suction fan 84 of the pre-fixing conveying belts 83*a* and 83*c* on both ends. Therefore, the sheet P can be guided to the fixing portion 9 with the convex shape illustrated in FIG. 6D.

An effect exerted for toner image deviation by a sheet shape in this embodiment will be described with reference to a graph in FIG. 8. In the graph in FIG. 8, a lateral axis indicates a position of a sheet in the longitudinal direction, and a vertical axis indicates variation [mm] in height at the pre-fixing conveying portion 8.

As described above, the factor of generation of image deviation deeply relates to a pressure distribution in the fixing nip portion and rigidity of a sheet. Hence, as a basic solution which can be used for wide media, it seems possible to make a pressure balance of the fixing nip portion variable according to type of sheets. However, in this case, the apparatus is complicated and this is not practical. Therefore, according to the present invention, a sheet before the sheet enters the fixing portion 9 is formed into a shape in which the image deviation is less prone to appear in response to the media by the pre-fix conveying portion 8 so that this method is suitable for wide media.

Figure 8:
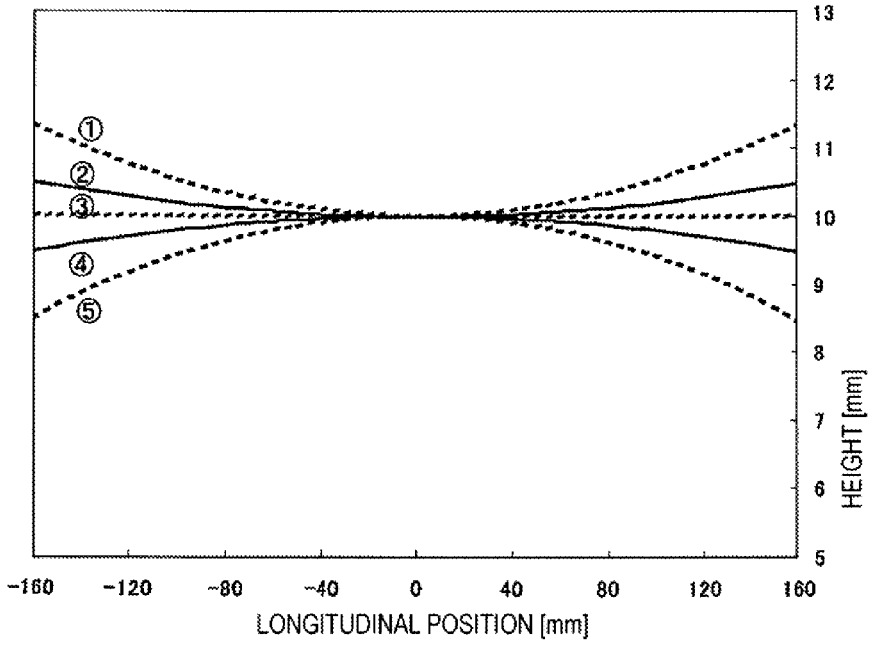
FIG. 8 is a summary diagram of an effect obtained by a shape of a sheet conveyed from the pre-fixing conveying portion to the fixing portion in the first embodiment.

According to FIG. 8, a sheet is formed into the concave curl shape (II) which is conveyed in a manner that an end of the sheet first comes into contact with the fixing nip portion. As a result, even if the central portion moves relatively faster than the end at the fixing nip portion, it is found that the moved central portion and the initial concave curl shape cancel out each other, and the image deviation is less prone to be generated in the end. On the other hand, if the sheet is formed into the convex curl shape (III) in which the center of the sheet first comes into contact with the fixing nip portion, it is found that since the central portion is first conveyed by the fixing nip portion, even if the end is conveyed faster due to temperature rise of the end, image deviation is less prone to be generated in the central portion.

The entering timing of the fixing nip portion is very slight deviation, but since a deformation amount of the sheet of an initial tip end is amplified in the fixing nip portion, an effect of suppressing the image deviation is increased. However, if the sheet is excessively largely curled, an image surface of the tip end of the sheet rubs against the fixing roller 51 and the image deviation is generated in some cases. Therefore, it is necessary to change the deformation amount depending upon the configuration of the fixing portion 9 or type of the media. In this embodiment also, passing of sheets was tested using various types of media as will be described below, and a shape of the pre-fixing conveying portion 8 was determined according to a sheet.

Here, 100 two-sided coated paper sheets having small basis weight (73 [g/m$^2$]) and 100 two-sided coated paper sheets having large basis weight (300 [g/m$^2$]) were continuously made to pass through the image forming apparatus of this configuration such that both sides were made to pass the image forming apparatus. At that time, sheets of image surfaces in which toner layer deviation was generated were recorded. Table 1 shows the result of the effect. In Table 1, the projecting amount in the height direction of the pre-fixing conveying portion drive was changed in increments of 5 mm from −15 mm to +15 mm.

TABLE 1

| Type of | Lateral width | Basis weight | Variation in height of a portion of 100 mm from central portion [mm] | | | | | | |
|---|---|---|---|---|---|---|---|---|---|
| paper | [mm] | [g/m$^2$] | −15 | −10 | −5 | 0 | 5 | 10 | 15 |
| 13 × 19 | 330 | 73 | End deviation | End deviation | End deviation | End deviation | Passed | Passed | Passed |
| 12 × 18 | 305 | 73 | End deviation | End deviation | Passed | Passed | Passed | Passed | Central portion deviation |

TABLE 1-continued

| Type of paper | Lateral width [mm] | Basis weight [g/m$^2$] | Variation in height of a portion of 100 mm from central portion [mm] | | | | | | |
|---|---|---|---|---|---|---|---|---|---|
| | | | −15 | −10 | −5 | 0 | 5 | 10 | 15 |
| A3 | 297 | 73 | End deviation | Passed | Passed | Passed | Central portion deviation | Central portion deviation | Central portion deviation |
| B5 | 257 | 73 | Passed | Passed | Passed | Central portion deviation | Central portion deviation | Central portion deviation | Central portion deviation |
| A4R | 210 | 73 | Passed | Passed | Passed | Passed | Passed | Passed | Conveyance failure |
| B5R | 182 | 73 | Passed | Passed | Passed | Passed | Passed | Conveyance failure | Conveyance failure |
| 13 × 19 | 330 | 300 | End deviation | End deviation | End deviation | Passed | Passed | Passed | Passed |
| A3 | 297 | 300 | End deviation | End deviation | Passed | Passed | Passed | Passed | Passed |
| B5 | 257 | 300 | Passed | Passed | Passed | Passed | Passed | Passed | Passed |
| A4R | 210 | 300 | Conveyance failure | Passed | Passed | Passed | Passed | Conveyance failure | Conveyance failure |
| B5R | 182 | 300 | Conveyance failure | Conveyance failure | Passed | Passed | Conveyance failure | Conveyance failure | Conveyance failure |

In Table 1, "end deviation" means that image deviation was found in an end of a sheet, "central portion deviation" means that image deviation was found in a central portion of a sheet, "conveyance failure" means that delay or skew feeding occurred at the conveying portion, and "passed" means that all of sheets normally passed.

In the Table, variations in height of the pre-fixing conveying portion 8 having an excellent result corresponding to "13×19", "12×18", "A3", "B5", "A4R", "B5R" which are types of paper shown in Table 1, "73" which is sheet basis weight [g/m$^2$], type of paper, and basis weight are stored in the Table as data. The controlling portion 90 reads data according to type (type of paper, lateral width and basis weight) of sheet which is set and input before forming an image by the image forming apparatus, and drives and controls the driving mechanism so that optimal conveyance states of the pre-fixing conveying belts 83*a* to 83*c* can be obtained.

In the fixing portion 9 in which the fixing nip portion is formed by a combination of the fixing roller 51 and the pressure belt 53 of this embodiment, it is known that image failures as shown in Table 1 are generated by a sheet P which sufficiently takes up moisture after a package sheet of sheets P is opened.

Generally, it is known that a sheet having higher moisture is weak in rigidity of paper and elasticity, and the sheet is prone to be deformed in the fixing nip portion. As moisture of a sheet is higher, the sheet is heated in the fixing nip portion and moisture is decreased, and a state variation amount of the sheet is high.

In Table 1, it can be found that image deviation is generated at an end in some cases when mainly the lateral width is 300 mm or more, and image deviation is generated in some case at a central portion when a size is 300 mm or less. This is due to variation in conveying velocity of an image caused by a pressure difference in the fixing nip portion between the central portion and the end, and this phenomenon frequently appears at a rear end of a sheet.

When the projecting amount of the pre-fixing conveying portion 8 in its height direction was increased or decreased and an entering shape into the fixing portion 9 was formed into a convex shape (minus direction), image deviation at the central portion was improved, and when the entering shape was formed into a concave shape (plus direction), image deviation at the end was improved. The improvement was also obtained for types of sheets between 73 [g/m$^2$] and 300 [g/m$^2$] of the trial, and levels of image deviation and tendency of conveyance failure were the same or higher. When a sheet having large basis weight was used, a conveying force became insufficient depending upon type of sheet having narrow width due to condition, or conveyance was delayed due to instability of delivery between the secondary transfer portion 89 and the fixing portion 9.

Figure 9:
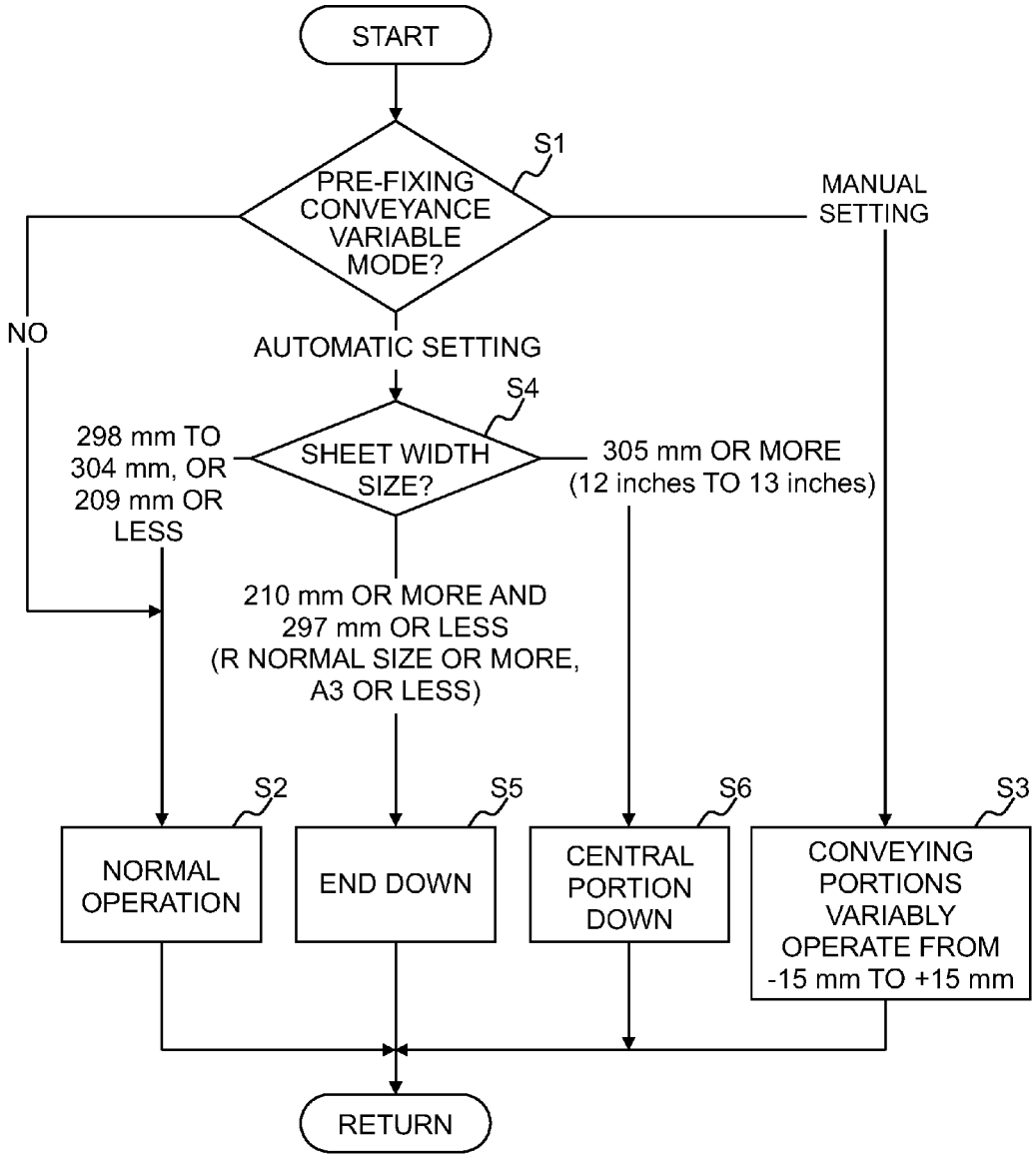
FIG. 9 is a flowchart concerning an operation in the first embodiment.

Based on these trials, operation of a configuration of the fixing portion in this embodiment was determined. A basic operation in the embodiment will be described with reference to a flowchart in FIG. 9.

A user has "pre-fixing conveyance variable mode" which can previously be set (step S1), and if this is set to NO, the controlling portion 90 does not change conveyance drive of the pre-fixing and carries out a normal operation (step S2). When the "pre-fixing conveyance variable mode" is set to manual setting, projecting amounts of the pre-fixing conveying belts 83*a* to 83*c* are determined depending on a projecting amount of the pre-fixing conveying portion 8 which is determined by the manual setting (step S3).

When the "pre-fixing conveyance variable mode" is set to automatic setting, the pre-fixing conveying portion 8 is set for each of the modes I, II and III depending upon width sizes of sheets which are made to pass by a job. When the width size of a sheet is 305 mm or more, the central pre-fixing conveying belt 83*b* is lowered by 10 mm . . . I, the sheet is concave-curled and conveyed to the fixing portion 9 (step S6). When the width size of a sheet is 210 mm or more and 297 mm or less, the controlling portion 90 lowers the end pre-fixing conveying belts 83*a* and 83*c* by 10 mm . . . III, and the sheet is convex-curled and conveyed to the fixing portion 9 (step S5).

When the width size of a sheet does not fall within the above-described ranges, i.e., when the width size of the sheet is 298 mm or more and 304 mm or less, or 209 mm or less, the projecting amount of the pre-fixing conveying portion 8 is set to a value of the normal operation . . . I in which the pre-fixing conveying belts 83*a* to 83*c* are set to ±0 mm (step S2). When special media are not set especially, the above-described automatic setting is not carried out, the flow of the manual setting (step S3) is carried out, and the media of the sheet is carried out. In step S3, pre-fixing conveying portions 8 (pre-fixing conveying belts 83*a* to 83*c*) are variably operated from −15 mm to +15 mm.

A fixing operation having less image failure can be realized even under stress conditions in which moisture of sheets is high, and the fixing operation of wide basis weight from thin paper to thick paper can be carried out by the fixing nip portion under the same condition. Especially concerning the thin paper, excellent effect could be obtained and constraint of sheet media could be decreased.

The first embodiment shows one example of the lower belt fixing portion but the same effect can also be obtained by a fixing portion of a configuration in which the fixing operation is carried out by upper and lower belts and by a configuration in which image deviation at an end when high velocity operation is carried out by upper and lower rollers causes a problem. A configuration of increase and decrease of the projecting amount of the central portion or end of the pre-fixing conveying portion in the vertical direction moves the entire pre-fixing conveying portion 8 upward or downward and in addition, an effect can also be obtained also by a configuration of a portion (only a downstream portion is projected upward).

In this embodiment, pre-fixing drive of three-division was carried out on a possibility that a configuration was complicated, but drive of the pre-fixing conveying portion can be divided more finely into four portions or five portions and in this case, flexibility of variation in behavior of a sheet is enhanced.

According to this embodiment, by driving and controlling the driving mechanism by the controlling portion 90, it is possible to obtain the conveyance state of the pre-fixing conveying belts 83*a* to 83*c* which was set in the Table according to type of sheet. According to this, it is possible to realize an image forming apparatus capable of preventing a sheet deformation such as curl and corrugation while solving the problem of generation of slip or distortion of a sheet P caused by velocity difference between the driving portions.

Figure 10:
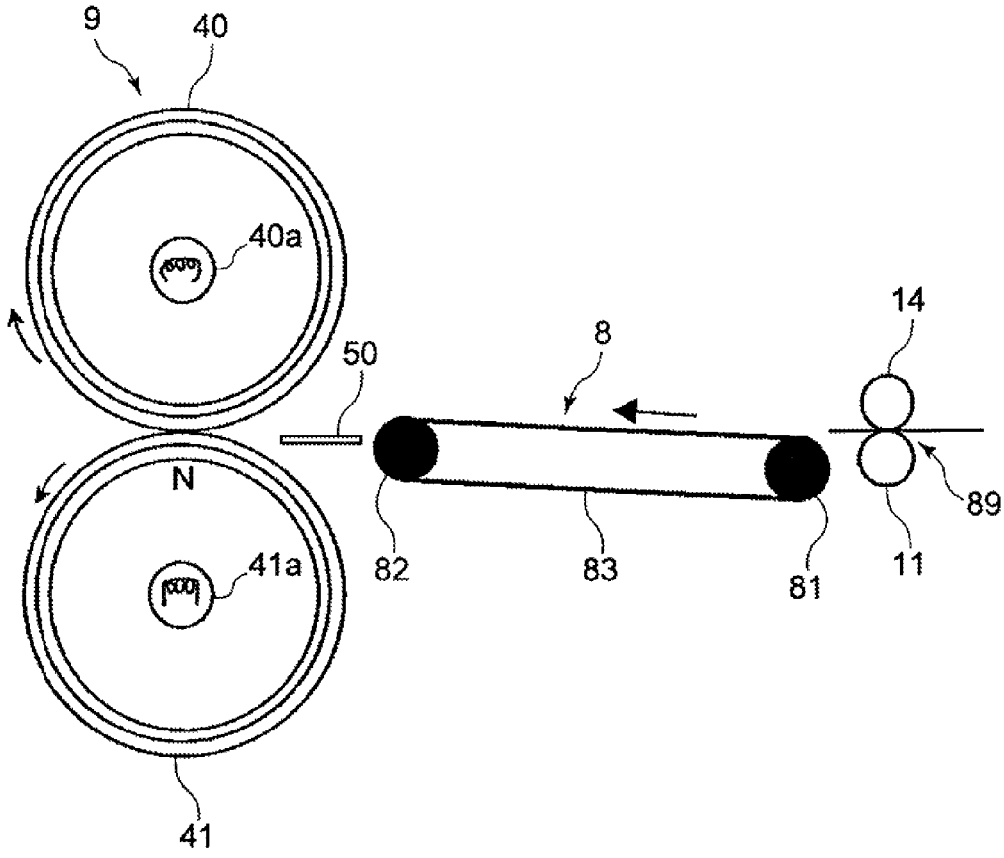
FIG. 10 is a schematic layout diagram of a fixing portion of a second embodiment according to the invention.

<Second Embodiment> Next, a second embodiment of the present invention will be described with reference to FIGS. 10 to 12. Since a basic configuration of an apparatus of this embodiment is the same as that of the above-described first embodiment, redundant description will not be repeated and a characteristic configuration of this embodiment will be described. Members having the same functions as those of the first embodiment are designated with the same reference numerals, and description thereof will not be repeated.

When images are formed (duplex printing) in the order from a first side to a second side by the image forming apparatus, if the first side receives stress such as a load and friction by the conveying roller, the image transfer portion and the fixing portion especially concerning a thin paper, the following phenomenon is generated. That is, it is widely known that curl or corrugation (deformation of a sheet in which a plurality of curls is superposed on each other) with respect to a traveling direction is generated when an image forming operation on a second side is carried out. Generally, when a toner image transferred to a sheet is fixed by pressurizing and heating, a tip end and a rear end in the conveying direction are warped, and the image surface is concave-curled.

The curl is generated by various factors such as material in a sheet, moisture, a nip shape of the fixing roller, a temperature, humidity and a toner amount. To correct this curl, a conveying route which is curved in a direction opposite from the curl is provided, and the sheet whose fixing operation was completed is discharged through the curved route. As another method, there is widely used an apparatus in which only line velocity of an upstream conveying roller of two sets of rollers in the sheet conveying direction is increased, slack is formed in a sheet and a curl is corrected. However, it is difficult to reliably correct a shape within a short pre-fixing time of a second side after a first side is fixed.

If a largely curled sheet reaches the fixing portion, deviation of projecting timing into the fixing portion and image failure caused by image rubbing or slip is generated in some cases. In this embodiment, attention is paid to a deformation direction of a sheet of deformation (curl) of the sheet before the fixing portion which becomes a problem of abnormality, and it is an object of the embodiment to stabilize the projecting state into the fixing portion by making the deformation direction parallel to the traveling direction of the sheet, and to improve sheet behavior.

Since the conveying force and the deformation state of a sheet are determined mainly by a width size of the sheet and basis weight, one of a convex shape and a concave shape having a higher effect is selected depending upon the width size of the sheet.

The controlling portion 90 changes a shape of a sheet so that failure is not generated in the fixing operation immediately before the fixing portion 9 by increasing or decreasing the projecting amount of the pre-fixing conveying portion 8. This will be described with reference to FIGS. 11A to 11D. FIGS. 11A to 11D are diagrams for describing the deformation states of sheets P in this embodiment.

Figure 11A:
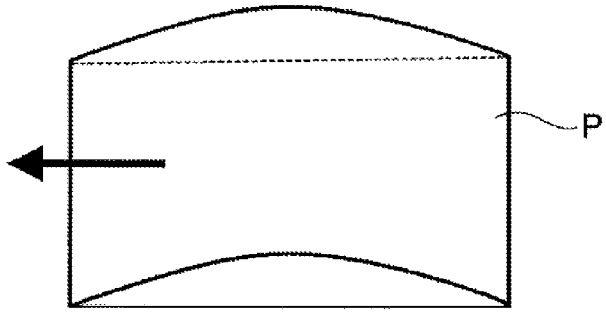
FIGS. 11A to 11D are diagrams for describing a deformed state of a sheet in the second embodiment.
Figure 11B:
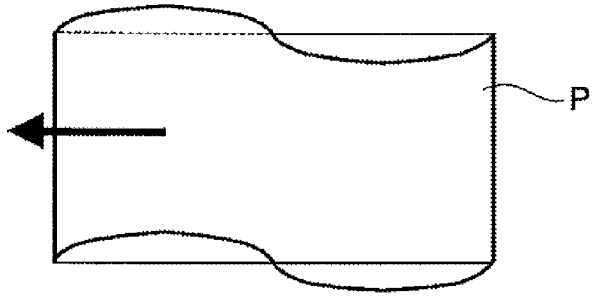
Figure 11C:
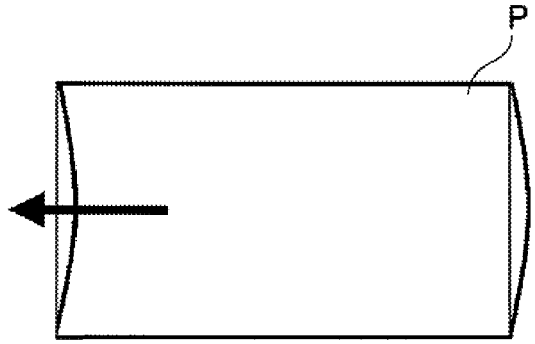
Figure 12:
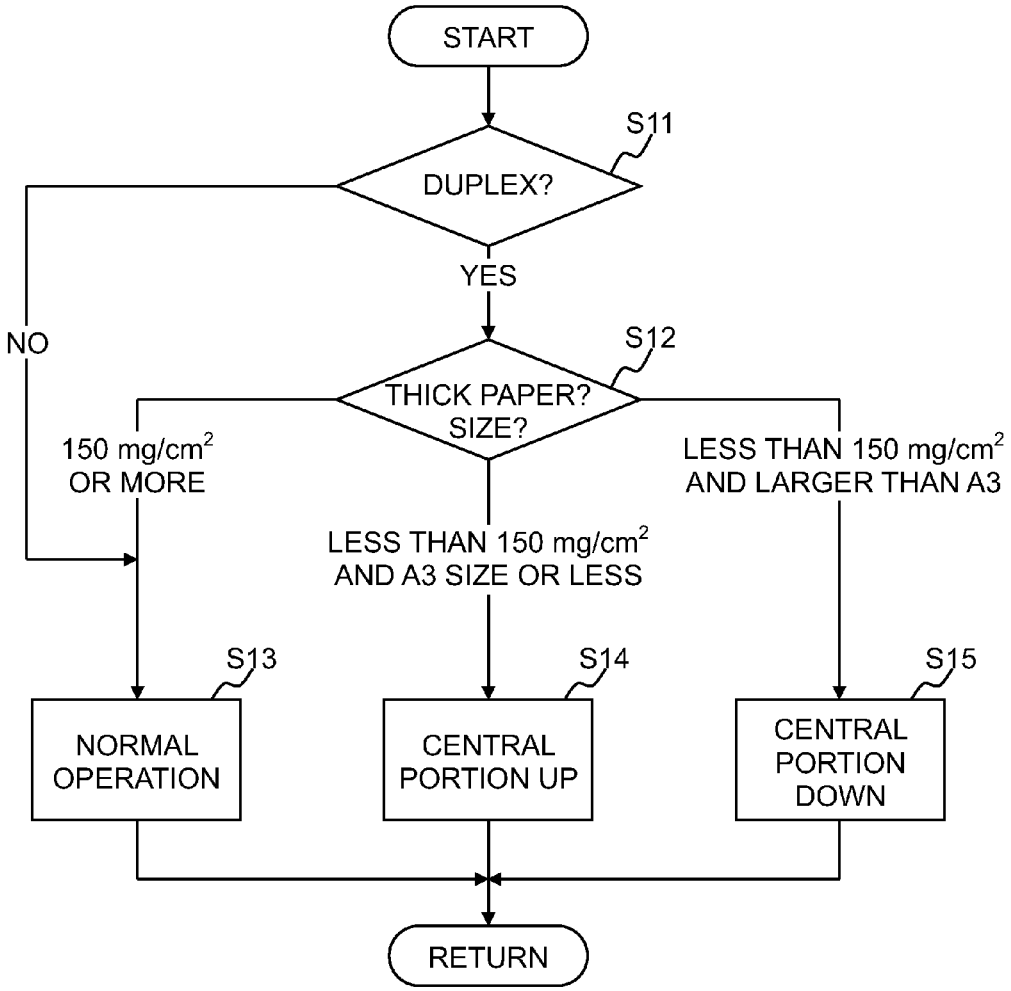
FIG. 12 is a flowchart concerning an operation in the second embodiment.

When the curl correction is insufficient, the sheet whose first side fixing operation is carried out is normally turned over by the turn-over portion 92 by the pressurizing and heating operations of the fixing roller, and when its second side becomes an image surface, a central portion swells as compared with a tip end and a rear end in the sheet-passing direction and the sheet enters the fixing portion 9 (FIG. 11A). Further, even when a curl correcting apparatus (not illustrated) is used, the sheet is corrugated under some conditions due to material in the sheet, moisture and an amount of toner (FIG. 11B).

Figure 11D:
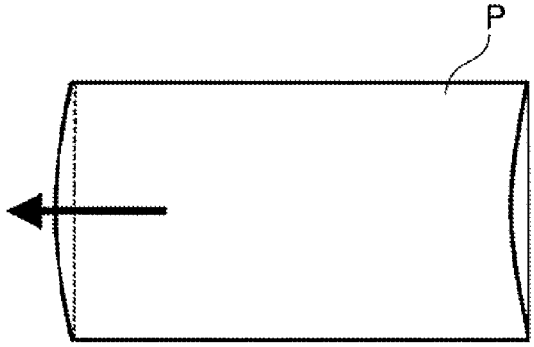

By canceling a curl shape by concave convex in a 90° direction with respect to a deformed concave convex direction, it is possible to form the sheet into a shape in which its end is lowered with respect to the traveling direction (FIG. 11C) or into a shape in which its central portion swells with respect to the traveling direction (FIG. 11D). Since a deformation degree of the sheet P can be controlled by the operation of the pre-fixing conveying portion 8, if delay or image rubbing of a sheet P when the sheet enters the fixing portion 9 is within a certain amount, there is no problem.

[Fixing portion 9] In this embodiment, an image heating type fixing portion 9 is employed. A configuration of this fixing portion 9 will be described in detail with reference to FIG. 10. FIG. 10 is a schematic layout diagram of the fixing portion 9 of this embodiment.

The fixing portion 9 includes a fixing roller 40 provided therein with a halogen heater 40*a* which is a heating member, and a pressure roller 41 provided therein with a halogen heater 41*a* which is a heating member. The fixing roller 40 and the pressure roller 41 constitute a pair of rotating members of the fixing portion. The fixing roller 40 and the pressure roller 41 are formed as a pair of fixing members which are rotatably disposed in a state where they are pressurized against and in contact with each other by a predetermined pressure (e.g., total pressure is about 784 N (about 80 kg)) by a pressurizing mechanism (not illustrated). In FIG. 10 represents a fixing nip portion N formed by pressure contact between the fixing roller 40 and the pressure roller 41.

The fixing roller 40 and the pressure roller 41 are rotated and driven by driving systems (not illustrated) in the direction of the arrow. Thermistors (not illustrated) which are temperature detecting members abut against the fixing roller 40 and the pressure roller 41, respectively, and the thermistors detect temperatures of the fixing roller 40 and the pressure roller 41. Based on the temperature detection information, the halogen heaters 40*a* and 41*a* are controlled by the controlling portion 90, and control is performed such that the temperatures of the fixing roller 40 and the pressure roller 41 are constantly maintained at about 165° C. According to this, a non-fixed image formed by a developer such as sharp melt toner transferred to a sheet P passes through the fixing nip portion N between the fixing roller 40 and the pressure roller 41, heated and pressurized, and fixed onto the sheet P.

[Pre-fixing conveying portion 8] The pre-fixing conveying portion 8 of the embodiment is almost the same as that of the first embodiment, but in this embodiment, to simplify the configuration, a driving mechanism which increases and decreases the projecting amount is provided only on the central pre-fixing conveying belt 83*b* among the pre-fixing conveying belts 83*a* to 83*c*. As described above with reference to FIG. 7, the driving mechanism includes the cam operating motor 91, the projecting-amount changing cam 85 and the transmission member 88.

The operation of this embodiment will be described with reference to a flowchart in FIG. 12. FIG. 12 is a flowchart concerning the operation of this embodiment.

A curl of a first side appears strongly when the sheet is thin, but in the configuration of the embodiment, if the sheet has basis weight of 150 g/m$^2$ or more, a fixing operation of a second side at the time of duplex printing is not hindered. A configuration in which a contact area between the sheet P and the pre-fixing conveying belts 83*a* to 83*c* was wide was selected due to a problem of a sheet conveying force (a central portion of a sheet was mainly conveyed when a width of the sheet was narrow, and ends of a sheet were mainly conveyed when a width of the sheet was wide).

First, it is determined whether a job is a duplex image forming (duplex printing) job (S11) and as a result, if the job is single-sided printing (S11: NO), this configuration is not operated. That is, this state is a normal operation in which the projecting amount is not changed (S13). Even at the time of the duplex image forming operation, if it is determined in step S12 that the basis weight of the passing sheet is 150 g/m$^2$ or more, the normal operation is carried out (S13).

When the job is the duplex image forming job and the basis weight of the sheet is less than 150 g/m$^2$, the curl correcting operation is carried out. When a sheet width is greater than A3 size, since the conveying ability is higher if the sheet is conveyed by the pre-fixing conveying belts 83*a* to 83*c* on the both ends, the projecting amount of the central pre-fixing conveying belt 83*b* of the pre-fixing conveying portion 8 is lowered by −10 mm (S15). In this case, the conveyed sheet P has such a shape that the central pre-fixing conveying belt 83*b* is lower than the pre-fixing conveying belts 83*a* to 83*c* on the both ends. When the sheet width is A3 size or smaller, the projecting amount of the central pre-fixing conveying belt 83*b* is increased by +10 mm (S14). In this case, the conveyed sheet P has such a shape that its central portion is higher than both ends.

In this embodiment, the operation of the pre-fixing conveying portion 8 is determined based on the basis weight and the width of the sheet P of the second side, but many apparatuses which detect a curl state of a sheet during the sheet-passing operation are discussed. It is possible to determine the operation of the pre-fixing conveying portion 8 when a curl degree is high during the sheet-passing operation are discussed. In this case, a detector which detects the conveying state of a sheet is disposed in the fixing portion 9, and controlling portion 90 controls the driving mechanism such that the projecting amounts of the pre-fixing conveying belts 83*a* to 83*c* are changed based on a detection result of the detector.

According to this embodiment also, substantially the same effect as that of the first embodiment can be obtained, and it is possible to obtain an effect that even if a curl is generated on a first side of a sheet, the fixing operation of a second side can stably be carried out.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-146193, filed Jun. 28, 2010, which is hereby incorporated by reference herein in its entirety.

What is claimed is:

1. An image forming apparatus comprising;

a transfer portion which transfers a toner image to a conveyed sheet;

a fixing portion which fixes the toner image transferred by the transfer portion;

a conveying portion disposed between the transfer portion and the fixing portion, the conveying portion includes a plurality of sheet conveying members arranged in parallel to a width direction intersecting with a sheet conveying direction, the sheet conveying members convey the sheet on sheet conveying surfaces of the sheet conveying members, to which the toner image is transferred by the transfer portion, to the fixing portion;

the driving mechanism drives such that at least one of the plurality of sheet conveying members is projected in a direction perpendicular to the sheet conveying surface and a projecting amount of the at least one sheet conveying member is changed with respect to the other sheet conveying member to form the sheet into a concave curl shape or a convex curl shape in the width direction; and the controlling portion controls the driving mechanism such that the projecting amount of the sheet conveying member is changed to change a curl amount of the sheet based on a data of a state-setting table which is set according to sheet type, wherein the conveying portion conveys the sheet, which is formed in the concave curl shape or the convex curl shape, into the fixing portion.

2. The image forming apparatus according to claim 1, wherein the controlling portion changes the projecting amount of the sheet conveying member according to the type of a sheet which passes through the conveying portion.

3. The image forming apparatus according to claim 2, wherein the controlling portion controls the driving mechanism such that the projecting amount of the sheet conveying member which is disposed at a central portion in the width direction is increased or decreased relative to the other sheet conveying members disposed on both sides of the sheet conveying member.

4. The image forming apparatus according to claim 1, wherein the plurality of sheet conveying members is conveying belts which suck and convey the sheet to which the toner image is transferred.

5. The image forming apparatus according to claim 1, wherein the controlling portion controls the driving mechanism so that a direction of the curl shape of a first size of sheet is opposite the direction of the curl shape of a second size of sheet, which is larger than the first size of sheet.

6. The image forming apparatus according to claim 1, wherein controlling portion controls such that the driving mechanism is not operated in a case of single-sided printing and the driving mechanism is operated in a case of duplex printing.

7. The image forming apparatus according to claim 6, wherein controlling portion controls the driving mechanism such that, in a case of duplex printing operation, a direction of the curl shape of a sheet whose width is greater than a predetermined size is opposite a direction of the curl shape of a sheet whose width is smaller than the predetermined size.

* * * * *